United States Patent [19]

Halbich

[11] 4,084,695

[45] Apr. 18, 1978

[54] PLASTIC PILLBOX

[76] Inventor: Frank Halbich, 11923 Salem Dr., Granada Hills, Calif. 91344

[21] Appl. No.: 721,786

[22] Filed: Sep. 9, 1976

[51] Int. Cl.[2] ..... B65D 83/04

[52] U.S. Cl. ..... 206/532; 206/538; 206/561; 206/601; 220/22

[58] Field of Search ..... 206/532, 538, 539, 561, 206/498; 220/22, 20

[56] References Cited

U.S. PATENT DOCUMENTS

| | | | |
|---|---|---|---|
| D. 149,519 | 5/1948 | Reynolds | 220/20 |
| 2,125,856 | 8/1938 | De Witt | 220/22 |
| 2,538,924 | 1/1951 | Stearn | 220/20 |
| 3,703,955 | 11/1972 | Inacker | 206/532 |
| 3,771,695 | 11/1973 | Pehr | 206/538 |
| 3,807,551 | 4/1974 | Ankney | 206/539 |
| 3,823,817 | 7/1974 | Hughes | 220/20 |

*Primary Examiner*—George E. Lowrance
*Assistant Examiner*—Joseph M. Moy
*Attorney, Agent, or Firm*—Herzig & Walsh Incorporated

[57] ABSTRACT

A clear plastic pillbox having an intermediate longitudinal channel and lateral partitions which form a multiplicity of compartments therein for storage and convenient dispensing of medicament tablets. The pillbox is sealed by a clear plastic cover having a plurality of slots through its surface which form peripheral seals around the projections of the lateral partitions above the sidewalls of the pillbox and thus individual sealing tabs are provided for each of the compartments created by the longitudinal channel and lateral partitions. The individual sealing tabs are frangible and may be broken away to provide access to particular compartments, which may be pre-loaded by pharmacists with medicament tablets or doses of medication for scheduled use.

6 Claims, 5 Drawing Figures

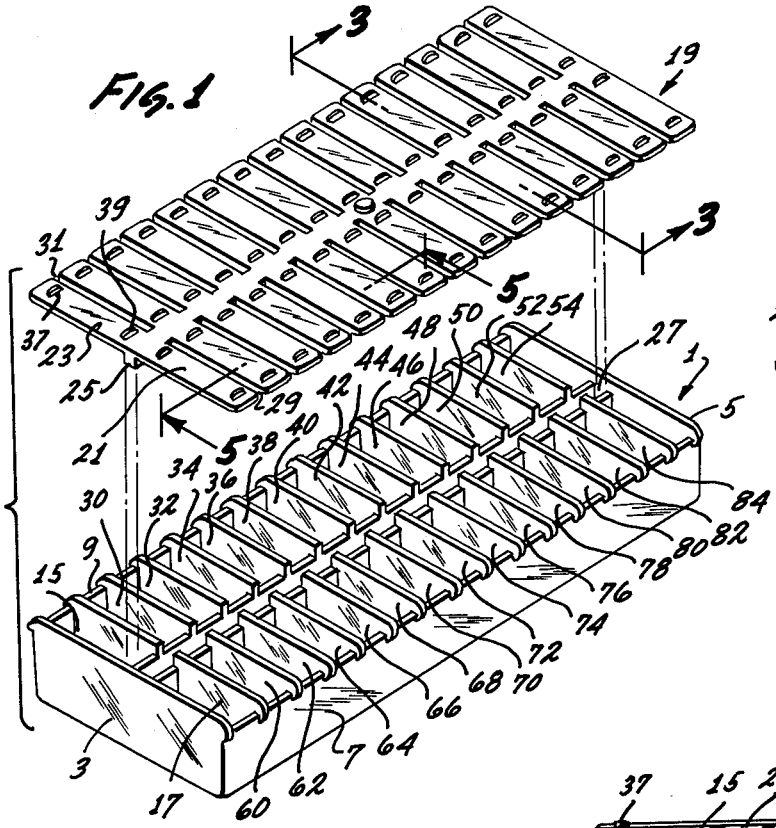
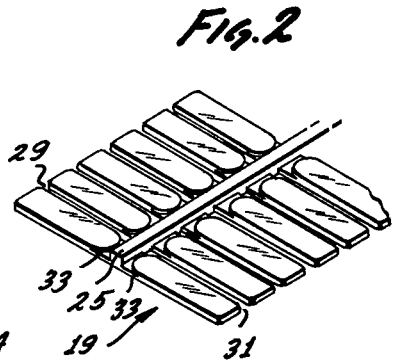
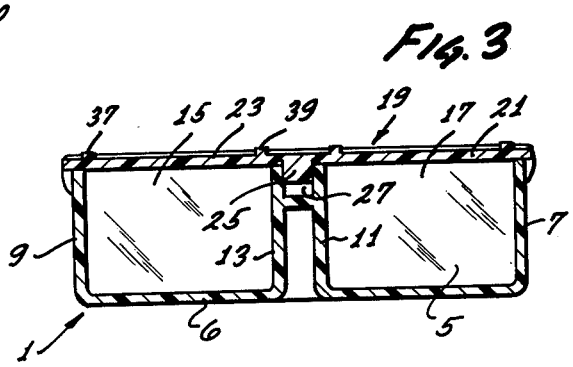
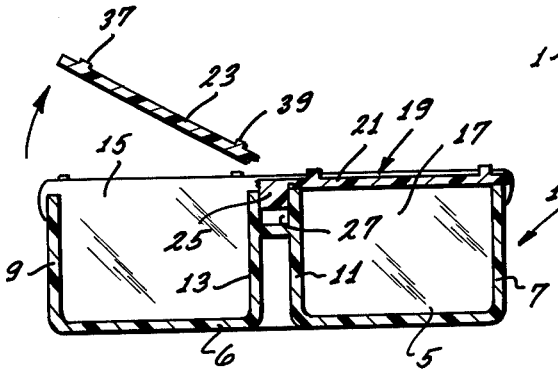
FIG. 4
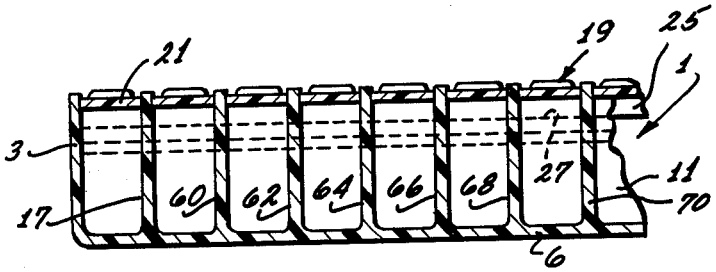
FIG. 5

PLASTIC PILLBOX

BACKGROUND OF THE INVENTION

1. Field of the Invention

This invention relates to a medication dispensing box, having a multiplicity of compartments, which are covered and sealed by tabs which form a uniform continuous surface over each of the compartments. The tabs are frangible and may be broken away individually to gain access to a particular compartment, leaving the remaining compartments sealed. Access to the medication may therefore be accomplished on a scheduled basis.

2. Description of the Prior Art

Containers for dispensing medicament tablets, or the like, where the container unit is formed with parallel rows defining a tray with an enclosure thereover and where cover segments may be rupturable in a cyclical manner, thereby providing medicines on a daily basis, has been disclosed in the prior art, namely U.S. Pat. No. 3,283,885.

Similarly, in U.S. Pat. No. 3,703,955, a multi-compartmented box, having a detachable cover to close the compartments after they have been loaded with medicament tablets for later dispensation, has also been disclosed in the prior art. However, access to these compartments which are formed by a central longitudinal extending wall is achieved by breaking through the end walls of the multi-compartment box.

According to the present invention, a clear plastic pill box is provided having a longitudinal rib with lateral partitions extending from either side thereof, forming a multiplicity of compartments. Each compartment may be preloaded separately with medicament tablets in a prescribed medical dosage to be taken on a scheduled basis if desired or prescribed. After the multiple compartments of the pill box are loaded, a clear plastic cover is attached, which covers the spaces between the respective lateral partitions, forming a continuous cover for the entire box. The clear plastic cover contains a plurality of slots between which the lateral partitions extend. Access to each compartment is accomplished by merely breaking off the portion of the plastic cover between the slots, thereby exposing the compartment containing the medicament tablets. The pill box has the advantage of allowing for preloading by a pharmacist or other skilled person and the user simply breaks off the portion of the cover to gain access to the medication.

SUMMARY OF THE INVENTION

In accordance with the present invention, a multi-compartmented box is formed by a longitudinal rib, having lateral partitions extending from either side thereof, terminating at the side walls of the box. The compartments are covered by a plastic cover, having a plurality of slots through which the lateral partitions of the pill box extend after the cover is affixed to the pill box. The sections between the slots of the cover or tabs, therefore, form an enclosure for each of the separate compartments of the pill box. The clear plastic cover is designed with symmetrical tab sections extending oppositely from a central channel member embodied in the cover, where the channel member for final sealing of the cover after the pill box has been loaded with medicament tablets is bonded to the longitudinal rib of the pill box. The lateral partitions of the pill box extend through the slots when the plastic cover is bonded to said pill box for final assembly. This, therefore, provides a plurality of tabs, which are frangible and form a sealed cover for each of the individual compartments. When access is desired to any of the individual compartments, the tab covering may be broken away, leaving the remaining compartments sealed and intact. These tabs are disposable after being broken away to expose the individual compartments and therefore provide a method of scheduled medicament usage. When access has been gained to all the individual compartments, the remaining pill box tray is disposable.

It is, therefore, an object of the present invention to provide a multi-compartmented pill box with a slotted section cover where each section of said cover forms a closure to the individual compartments of the pill box and may be selectively broken away to gain access to each of the said individual compartments.

It is a further object of this invention to provide a pill box having a longitudinal rib with lateral partitions extending therefrom whereas to form individual compartments into which medicament tablets of a prescribed dosage may be stored where selective access may be gained to each individual compartment by breaking away the cover thereof.

It is also an object of the present invention to provide a multi-compartmented pill box having a slotted clear plastic cover, where said slots form sections of a symmetrical design terminating at a central member, which interfits with a longitudinal rib of the pill box, where the sections between said slots form covers for each of the compartments and may be broken away by the user of said pill box.

Further objects and additional advantages of the invention will become apparent in the following detailed description and annexed drawings.

BRIEF DESCRIPTION OF DRAWINGS

FIG. 1 is a perspective view of the plastic pill box and cover.

FIG. 2 is a fragmented bottom view of the cover for the plastic pill box.

FIG. 3 is a sectional side view taken along the line 3—3 of the assembled pill box.

FIG. 4 is a sectional side view of the assembled pill box with a cover tab partially broken away.

FIG. 5 is a sectional view taken along the line 5—5 of the assembled pill box and cover.

DESCRIPTION OF THE PREFERRED EMBODIMENT

Referring to FIG. 1, the present invention embodies an elongated, one-piece, rectangular box 1 having ends 3 and 5, a bottom 6, and longitudinal side members 7 and 9, integrally forming the box enclosure.

Longitudinal members 11 and 13 extend continuously between end walls 3 and 5 and are integral with said sidewalls, forming a central longitudinal channel which divides the rectangular box 2 into two distinct compartmental sections. As can be seen in FIG. 1, end walls 3 and 5 extend above the horizontal plane which contains the upper surface of longitudinal side members 7 and 9, and longitudinal central members 11 and 13. A plurality of lateral partitions 15, 30, 32, 34, 36, 38, 40, 42, 44, 46, 48, 50, 52 and 54 extend between central longitudinal member 13 and integrally engage side wall 9, forming a multiplicity of compartments. Similarly, a plurality of lateral partitions 17, 60, 62, 64, 66, 68, 70, 72, 74, 76, 78, 80, 82 and 84 extend laterally between central longitudinal member 11 and longitudinal side member 7, forming a multiplicity of storage compartments.

In its preferred embodiment, the pill box is made of molded synthetic plastic by a plastic injection molding process. As described above, said plurality of lateral partitions form a multiplicity of storage compartments and create a general tray appearance for the container portion of rectangular box 1. As can be more particularly seen in FIG. 4, lateral partitions 15 and 17 typical of lateral partitions have an upper horizontal surface which extends above the upper horizontal surfaces of longitudinal side members 9 and 13, and 11 and 7. This height differential provides an advantageous method by which an enclosure cover may be affixed to box 1 so as to seal the various compartments formed by the plurality of lateral partition members.

Enclosure cover 19 is clear or transparent and made of molded plastic by a plastic injection molding process, and as can be seen on FIG. 1, cover 19 contains a plurality of tabs, typical of which are denominated tabs 21 and 23, which extend laterally from a central channel member 25. When cover 19 enmeshes with box 1, channel member 25 inserts into groove 27 where groove 27 consists of the inner space between longitudinal members 11 and 13.

Cover 19 may be bonded to said pill box by an adhesive or other suitable means by which said cover may firmly engage said pill box. A bottom view of enclosure cover 19 is shown on FIG. 2. It can be seen that channel member 25 is continuous and embodies the terminations of the plurality of tabs, typical thereof being tabs 21 and 23, which integrally extend from said channel member 25 in a cantilever fashion.

As illustrated in FIG. 1, the plurality of tabs 21 and 23 in enclosure cover 19 are separated by a plurality of slots, typical of which are designated for descriptive purposes as slots 29 and 31, shown extending through the surface of said cover where the width of said slots is approximately equivalent to the width of partition members 15 and 17, such than when enclosure cover 19 is seated in groove 27 by the insertion of channel 25 into said groove, slots 29 and 31 will be peripherally contained by the extensions of lateral partitions 15 and 17, thereby forming individual covers for the multiplicity of compartments in the pill box.

The construction of enclosure cover 19 at the inboard sections of tabs 21 and 23, is identical and as can be seen by referring to FIG. 2, the inboard section of tab 23 at its juncture with channel member 25, contains a rupturable line 33, said line of arcuate shape and representing an area of weakness in tab 23 such that an external lifting force applied to the cantilever end of the tab will cause the tab to break away from enclosure cover 19, rupture occurring along said line 33. Thus, in the manner described, anyone of the plurality of tabs such as 21 and 23 may be broken away from their respective compartments within box 1, thereby exposing the contents therein.

By referring to FIG. 4, it can be seen that tab 23 by the application of a force at its outboard end 35, creates sufficient bending forces at line 33 to cause said tab to rupture or separate from enclosure cover 19, thereby exposing pill compartments 16 while the remaining multiplicity of compartments remain sealed by enclosure cover 19.

Referring again to FIG. 4, the cross-sectional view of tab 23 illustrates the outboard and inboard protuberances 37 and 39 on the upper surface of said tab where the protuberances are rectangular in cross-section. And as can be seen in FIG. 1, each one of the plurality of tabs comprising enclosure cover 19 contains protuberances located at the outboard and inboard sections of said tab. Protuberances 37 and 39 are conveniently located on the upper surface of tab 23 to assist the user in breaking said tab so as to expose compartment 16 and thereafter said protuberances 37 and 39 when tab 23 is inverted frictionally interfit with longitudinal side member 9 and longitudinal central member 13 thereby forming a temporary cover for said compartment. End 35 and protuberance 37, when tab 23 is in a sealed position, may be conveniently gripped by the thumb and forefinger with the index finger resting on protuberance 39, thereby allowing for the application of a suitable bending force to rupture tab 23 along arcuate line 33.

From the foregoing, it wlll be seen that each compartment in the pill box may be preloaded with medicament tablets and thereafter cover 19 may be sealed into position, so as to form a multiplicity of individual frangible tab covers for each of the respective compartments of the pill box. The gain access thereafter to the medication, the user merely breaks away the individual tab cover to expose the compartments and the contents therein. Thus, where the user is in need of medication on a scheduled basis, the pharmacist may preload the pill box compartment with appropriate tablet dosages, seal the cover, and access to the proper medication conveniently afforded by visual inspection and cyclic removal of the frangible tab covers.

The foregoing disclosure is representative of the preferred form of the invention and is to be interpreted in an illustrative rather than a limiting sense, the invention to be accorded the full scope of the claims appended hereto.

It is claimed:

1. A pillbox comprising:

a box having side walls, end walls, and a bottom;

at least one longitudinal member attached between said end walls and with said bottom and comprising a partition;

a plurality of lateral partitions extending between said at least one longitudinal member and said side walls of said box where said plurality of lateral partitions project above said at least one longitudinal member and said side walls, forming compartment in said box;

cover means having slots to interfit with said projections of said lateral partitions to comprise a closure for said box, said cover means defining at least one frangible tab covering one of said compartments.

2. The inventon as set forth in claim 1 wherein said cover means includes a channel fittable upon said at least one longitudinal member to seal said cover means.

3. The invention as set forth in claim 2 wherein said lateral partitions are integral with said side walls and said at least one longitudinal member.

4. The invention as set forth in claim 1 wherein said at least one tab includes an area of weakness such that an external lifting force applied to said tab will cause the latter to break away from said cover means.

5. The invention as set forth in claim 4 wherein said at least one tab contains an inner and an outer protuberance, said inner and outer protuberances interfitting with said side wall and said longitudinal member such that a temporary cover may be provided for one of said compartments from which said tab has been broken away.

6. The invention as set forth in claim 1 wherein said at least one longitudinal member comprises a pair of longitudinal members.

* * * * *